United States Patent [19]

Petracek et al.

[11] Patent Number: 4,841,749

[45] Date of Patent: Jun. 27, 1989

[54] WARP-KNIT, WEFT-INSERTED FABRIC WITH MULTIPLE SUBSTRATE LAYERS AND METHOD OF PRODUCING SAME

[75] Inventors: Vaclav Petracek, Bayside, N.Y.; Julius R. Schnegg, Burlington, N.C.

[73] Assignee: Burlington Industries, Inc., Greensboro, N.C.

[21] Appl. No.: 139,547

[22] Filed: Dec. 30, 1987

Related U.S. Application Data

[63] Continuation-in-part of Ser. No. 29,555, Mar. 24, 1987, which is a continuation-in-part of Ser. No. 784,355, , Pat. No. 4,682,480.

[51] Int. Cl.[4] ..... D04B 7/12

[52] U.S. Cl. ..... 66/190; 66/192; 66/193; 66/196; 66/84 A; 66/85 A

[58] Field of Search ..... 66/190, 192, 193, 196, 66/84 A, 85 A

[56] References Cited

U.S. PATENT DOCUMENTS

| | | | |
|---|---|---|---|
| H90 | 7/1986 | Kumar | 66/192 |
| 2,890,579 | 6/1959 | Mauersberger | 66/192 |
| 3,077,947 | 2/1963 | Peebles et al. . | |
| 3,279,221 | 10/1966 | Gliksmann | 66/192 |
| 3,362,862 | 1/1968 | King . | |
| 3,567,565 | 3/1971 | Jones et al. | 66/190 |
| 3,649,428 | 3/1972 | Hughes | 66/192 |
| 3,769,815 | 11/1973 | Ploch et al. | 66/192 |
| 3,906,748 | 9/1975 | Heilmann et al. . | |
| 4,145,468 | 3/1979 | Mizoguchi et al. . | |
| 4,172,170 | 10/1979 | Foye . | |
| 4,230,057 | 10/1980 | Kurz | 66/85 A |
| 4,361,618 | 11/1982 | Dufour et al. . | |
| 4,376,146 | 3/1983 | Juhasz et al. . | |
| 4,399,670 | 8/1983 | Hittel et al. | 66/84 A |
| 4,437,323 | 3/1984 | Hittel et al. | 66/84 A |
| 4,450,196 | 5/1984 | Kamat | 2/272 |
| 4,484,459 | 11/1984 | Hutson | 66/84 A |
| 4,497,863 | 2/1985 | Cogan, Jr. . | |
| 4,548,858 | 10/1985 | Meadows . | |
| 4,567,738 | 2/1986 | Hutson et al. | 66/84 A X |
| 4,608,290 | 8/1986 | Schnegg . | |
| 4,615,934 | 10/1986 | Ellison | 66/190 |
| 4,677,831 | 7/1987 | Wunner | 66/196 X |
| 4,682,480 | 7/1987 | Schnegg | 66/172 |
| 4,703,631 | 11/1987 | Naumann et al. | 66/84 A |

FOREIGN PATENT DOCUMENTS

| | | | |
|---|---|---|---|
| 68316 | 8/1969 | Fed. Rep. of Germany | 66/84 A |
| 2707001 | 9/1977 | Fed. Rep. of Germany | 66/193 |
| 2005318 | 4/1979 | United Kingdom . | |
| 2136026 | 9/1984 | United Kingdom | 66/196 |

OTHER PUBLICATIONS

Bahlo, "New Fabrics Without Weaving" Modern Textiles Magazine, 11-1965, pp. 51-53.

*Primary Examiner*—Ronald Feldbaum
*Attorney, Agent, or Firm*—Nixon & Vanderhye

[57] ABSTRACT

Aesthetic warp-knit, weft-inserted fabrics are produced having multiple substrate layers, warp yarns extending in the warp-wise direction of the fabric, and weft yarns extending in the weft-wise direction of the fabric. The warp and/or weft yarns are interposed between the multiple substrate layers. Warp stitching yarns forming stitch wales spaced-apart along the warp-wise direction of the fabric and stitched through the substrate layers hold the warp and weft yarns in position relative to one another and relative to the substrates. The substrates may also be provided in juxtaposed relationship to one another so as to increase the opacity, esthetics, and dimensional stability of the resulting fabric. Thermoplastic fibers may be incorporated in the fabric such that upon plasticization and subsequent cooling, they assist in binding of the resulting fabric.

28 Claims, 3 Drawing Sheets

WARP-KNIT, WEFT-INSERTED FABRIC WITH MULTIPLE SUBSTRATE LAYERS AND METHOD OF PRODUCING SAME

RELATED APPLICATIONS AND PATENTS

This application is a continuation-in-part of commonly owned, copending U.S. application Ser. No. 029,555 filed Mar. 24, 1987, entitled "Antique Satin Weft Inserted Warp Knit Drapery Fabric", which is, in turn a continuation-in-part of Ser. No. 784,355, now U.S. Pat. No. 4,682,480 issued on July 28, 1987, entitled "Warp-Knit, Weft-Inserted Fabric with Substrate and Method and Apparatus to Produce Same", the entire contents of said copending application and said issued patent being expressly incorporated hereinto by reference.

FIELD OF THE INVENTION

This invention relates to warp-knit, weft-inserted fabrics. More particularly, the invention relates to warp-knit, weft-inserted fabrics having multiple substrate layers against which the warp and weft yarns are held by stitching yarns.

BACKGROUND AND SUMMARY OF THE INVENTION

Warp-knit, weft-insertion (WKWI) fabrics have achieved greater popularity in recent years as lower cost alternatives in end-use applications typically reserved for woven-type fabrics. For example, WKWI fabrics having a "woven-like" appearance have been disclosed in U.S. Pat. No. 4,682,480 as useful as drapery fabrics and for other household and industrial end-use applications. Furthermore, the lower cost and dimensional stability of WKWI fabrics become more desirable (i.e., as compared to woven fabrics) in those end-use applications where the aesthetic appearance of the fabric is not critically important (e.g., as when the fabric is used as a mattress ticking).

The warp yarns in the fabrics disclosed in U.S. Pat. No. 4,682,480 are laid on a face of a substrate and plural weft yarns are then laid over the warp yarns, the warp and weft yarns being held to the substrate by means of plural stitch wales spaced-apart along the warp-wise direction of the fabric. While the use of such a non-woven substrate has proven to be quite satisfactory as a substitute for dense warp and/or tight filling for those fabrics that will subsequently be coated or foam-backed, the "fabric" side (i.e., that side of the fabric on which the warp and weft yarns are laid) is usually a loosely knit weft insertion construction which can only be as loosely knitted as the finishing frame is able to further process. Often therefore, such open constructions are fairly difficult to process because the weft yarns easily slip out since the fabric has no true selvage. In addition with such open constructions, the fabric lacks sufficient opacity, so that when used as a drapery fabric, the esthetic effect of the WKWI yarns is distorted by light passing through the fabric. "Tighter" warp and weft constructions, however, are cost-prohibitive. Therefore, what has been needed is a warp-knit, weft-insertion fabric having improved dimensional stability prior to the application of a coating layer—that is, a fabric whose warp and weft yarn are more dimensionally stable and opaque in an uncoated fabric form.

In accordance with the present invention, a warp-knit, weft-insertion fabric is provided with multiple substrates, the substrates serving to improve the dimensional stability and the opacity of the fabric and thus render it more useful in an uncoated form and create a more expensive-looking, self-lined product. The increased opacity is helpful because it blocks out light through the fabric when used as a drapery fabric, without the need of a separate lining. In one embodiment of the invention, the warp and/or weft yarns are interposed between at least two substrate layers such that the warp stitching yarns hold the two substrates one to another thereby also holding the warp and weft yarns in position relative to one another and to the substrates.

Another embodiment of the invention comprises the warp yarns being interposed between a pair of substrate layers while the weft yarns are laid over one of the substrate layers. The stitching yarns again hold the substrates one to another thereby also holding the warp and weft yarns in position relative to one another and to the substrates.

The multiple substrate layers may also be employed, in accordance with this invention, in a juxtaposed relationship one to another. In this case, increased opacity and dimensional stability as compared to a single substrate layer may be achieved without resorting to traditional foam backing and/or coating materials (although such backings and/or coatings may be provided with the fabrics of this invention if desirable or necessary for the particular end use application in which the fabrics are employed). The combination of different lightweight substrates, one for the inside layer to increase opacity and the other for the outside layer on the back, allows economical variations in the esthetics of self-lined draperies. The substrate combination may also be varied to obtain a softer or firmer hand, as desired. The softer hand would be used for draperies, while a firmer hand would be preferred for a window shade fabric.

These and other objects and advantages of the invention will become more clear to the reader after careful consideration is given to the following detailed description of the preferred exemplary embodiments.

BRIEF DESCRIPTION OF THE DRAWINGS

Reference will hereinafter be made to the accompanying drawings wherein like reference numerals throughout the various FIGURES denote like structural elements and wherein.

DETAILED DESCRIPTION OF THE PREFERRED EXEMPLARY EMBODIMENTS

Figure 1:
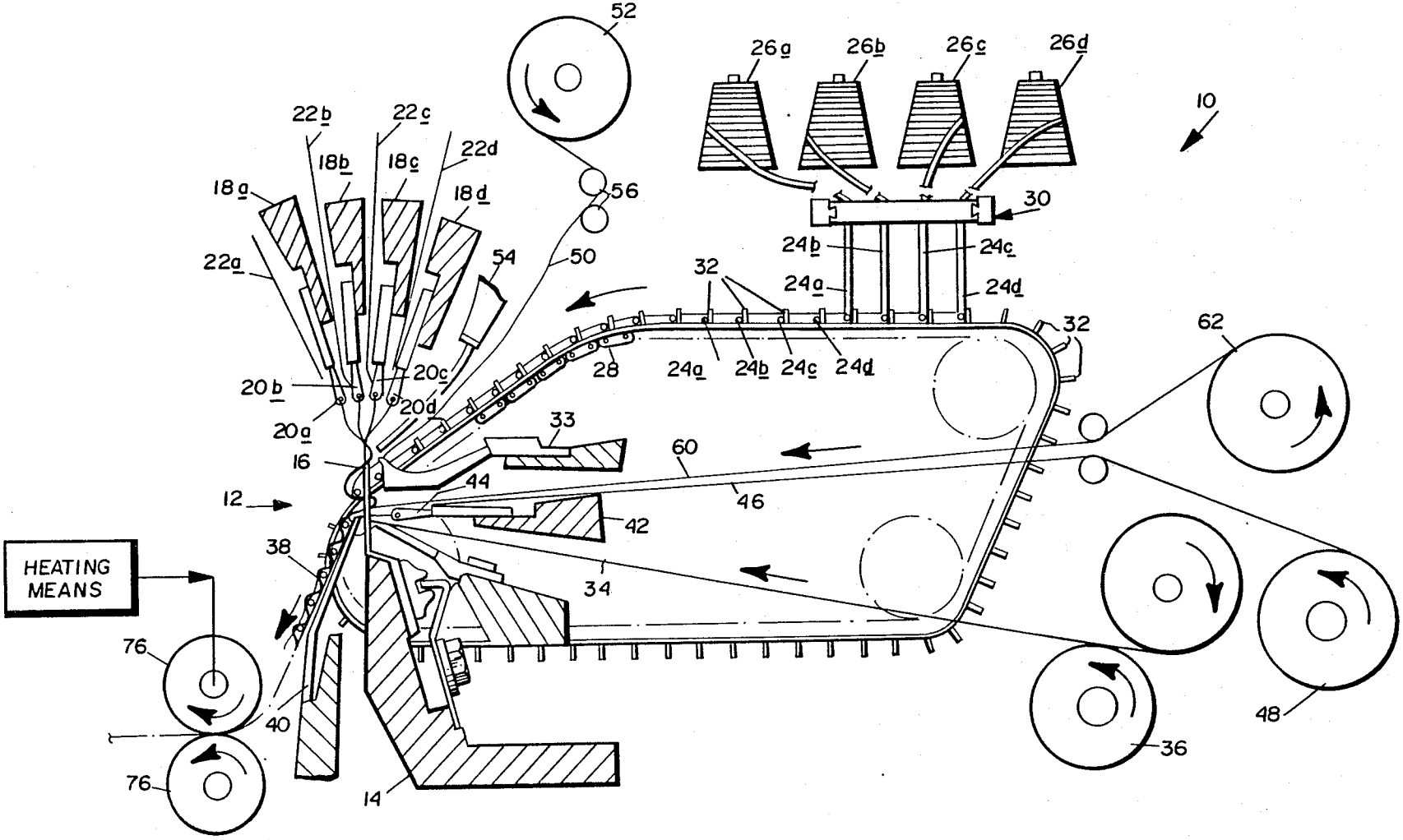
FIG. 1 is a schematic elevational view of a warp-knitting, weft-insertion machine useful to produce the fabrics of the present invention.

Referring specifically to FIG. 1, a warp-knitting machine 10 of a well known character is exemplified as including the modifications useful to produce the fabrics in accordance with the present invention. The warp-knitting machine 10 depicted in FIG. 1 generally shows the component parts of a Mayer Textile type RS4 MSU warp-knitting machine having been modified as will be discussed in greater detail below. Other warp-knitting machines can be similarly modified, however, so as to produce fabrics of this invention. For example, other raschel and tricot weft-insertion warp knitting machines such as Liba, Mayer, as well as stitch bonding machines, such as Malimo machines, can be advantageously modified in accordance with the discussion below.

As is conventional, apparatus 10 includes a knitting area 12 comprising a reciprocally movable needle bar 14 carrying a plurality of stitch needles 16 which cooperate with guide bars 18*a*–18*d* respectively carrying yarn guides 20*a*–20*d*. (Only one of the stitch needles 16 and one of each yarn guides 20*a*–20*d* is shown in FIG. 1 for purposes of clarity.) As is well known, needle bar 14 reciprocates in the vertical direction (as viewed in FIG. 1) to form the warp-knitting yarns 22*a*–22*d* (being guided by guide bars 18*a*–18*d*, respectively), into stitches at the knitting area 12. As is well known, the guide bars 18*a*–18*d* are shoggable in the cross-machine direction (i.e., perpendicular to the plane of FIG. 1) by suitable cam means (not shown) so as to cooperatively form, with respective needles 16, the desired stitches in the warp-wise direction.

Weft yarns 24*a*–24*d* to be inserted within the formed stitches at knitting area 12 are fed from respective yarn cones 26*a*–26*d* and disposed upon weft carrier chain 28 by means of transversely-movable carriage 30. That is, carriage 30 traverses perpendicular to the plane of FIG. 1 so as to extend the weft yarns 24*a*–24*d* in the cross-machine direction. The positions of the weft yarns 24*a*–24*d* are maintained upon carrier chain 28 by means of upstanding pins 32. Upon reaching the knitting area 12, the weft yarns 24*a*–24*d* are sequentially pushed, via reciprocating pusher bar 33, into the stitch loop being formed by means of the cooperating guide bars 18*a*–18*d* and stitch needles 16, thereby capturing the weft yarns in the resulting formed chain stitch.

A first substrate 34 is also conveyed from substrate beam 36 concurrently with the formation of the chain stitches and the insertion of the weft yarns 24*a*–24*d* at knitting area 12. As can be appreciated by those in this art, the stitch needles 16 penetrate the substrate 34 at the knitting area 12 during formation of the chain stitches which capture the weft-insert yarns 24*a*–24*d* so that the resulting warp-knit weft-insertion fabric 38 exits from knitting area 12 via trick plate 40.

A warp yarn guide bar 42 carrying a plurality of yarn guides 44 positioned in the cross-machine direction (only one yarn guide 44 being shown in FIG. 1 for clarity of presentation) is positioned upstream of the knitting area 12 and is operatively disposed between the conveyance path of the weft-yarns 24*a*–24*d* (established by means of carrier chain 28) and the conveyance path of substrate 34. The guide bar 42 is preferably stationary (i.e., immovable) but could be shoggable according to cam means (not shown) similar to those employed for shoggable transverse movement of guide bars 18*a*–18*d*. Each guide bar 42 therefore guides respective warp yarns 46 from warp yarn beam 48 and, due the positioning of yarn guide 44 between the conveyance paths of weft yarns 24*a*–24*d*, on the one hand, and substrate 34, on the other hand, the warp yarns 46 are interposed between the weft yarns 24*a*–24*d* and substrate 34.

The above description regarding FIG. 1 has thus far been directed generally to the WKWI knitting operation already described in U.S. Pat. No. 4,682,480, to which attention is directed for further information. In accordance with the present invention, multiple substrates may be provided at the knitting area 12 (in a manner which will be described in greater detail below).

According to one embodiment of the invention, a second substrate 50 may be fed from a substrate beam 52 concurrently with the formation of the chain stitches at knitting area 12 as was previously described. The second substrate 50 is preferably guided to knitting area 12 via a suitable guideblock 54 and guide rolls 56. As can be appreciated, the first and second substrates thus "sandwich" the laid-in warp and weft yarns, 46 and 24*a*–24*d*, respectively, therebetween—the warp and weft yarns, 46 and 24*a*–24*b*, being positionally maintained relative to one another and relative to substrates 34 and 50 by means of stitches formed with warp stitch yarns 22*a*–22*d*, respectively.

Figure 2:
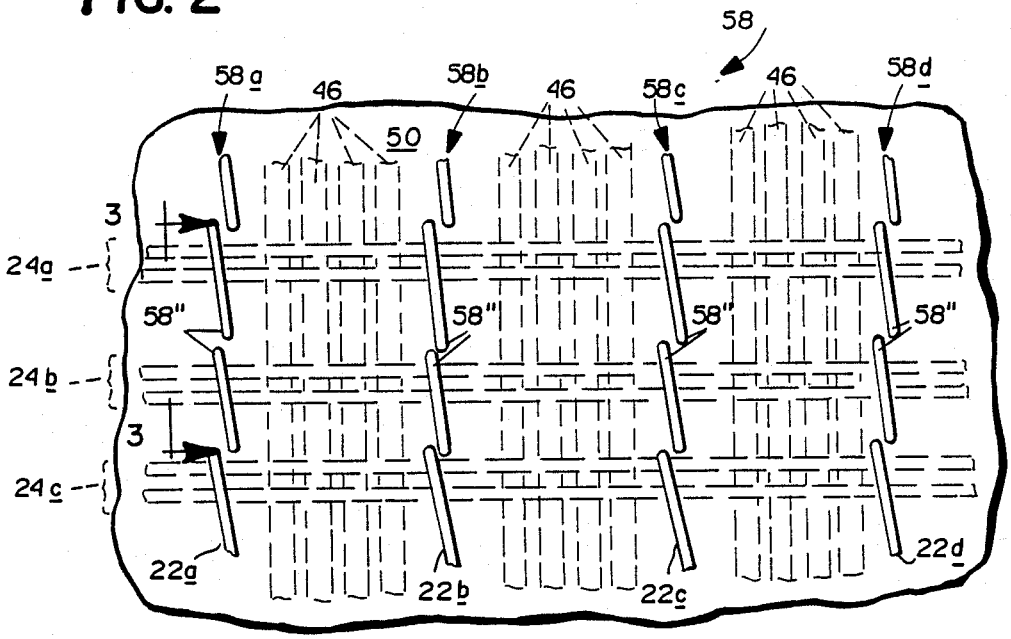
FIG. 2 is a schematic plan view of an exemplary fabric according to the present invention.
Figure 3:
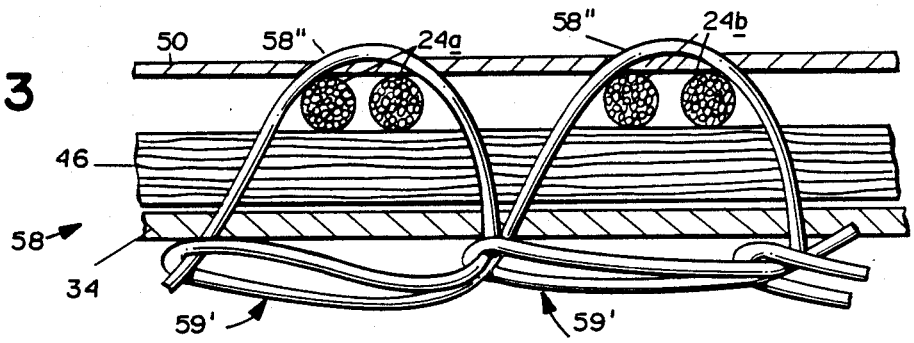
FIG. 3 is a cross-sectional schematic view of the fabric shown in FIG. 2 taken along line 3—3 thereof.

An exemplary fabric 58 produced by means of the machine 10 described thusfar is shown in accompanying FIGS. 2 and 3. As is seen, fabric 58 includes warp knitting yarns 22*a*–22*d* which have been formed into respective chain stitch wales 58*a*–58*d* with the stitch loops 59' thereof being located on the technical face of the fabric 58, while the stitch underlap 59" penetrates both substrates 34 and 50 and is disposed over the warp and weft yarns, 46 and 24*a*–24*d*, respectively. The stitch underlap 58" is thus visible on the technical back side of the fabric 58.

The weft yarns 24*a*–24*c* (yarn 24*d* not being visible in FIG. 2) may be inserted into the chain stitch courses of stitch wales 58*a*–58*d* while warp yarns 46 are interposed between the inserted weft yarns 24*a*–24*d* and substrate 34.

Figure 4:
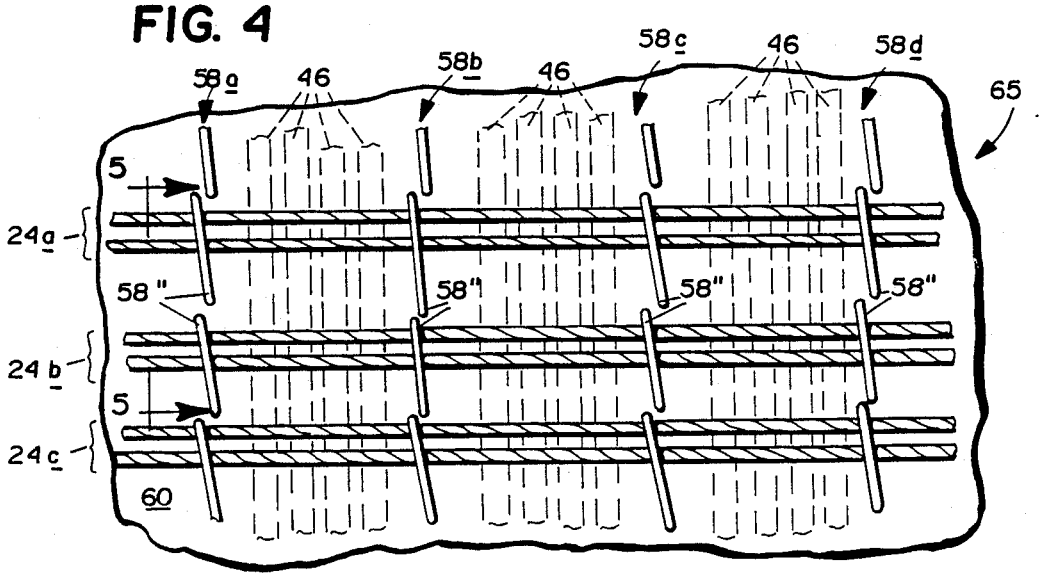
FIG. 4 is a schematic plan view of another exemplary fabric of this invention.
Figure 5:
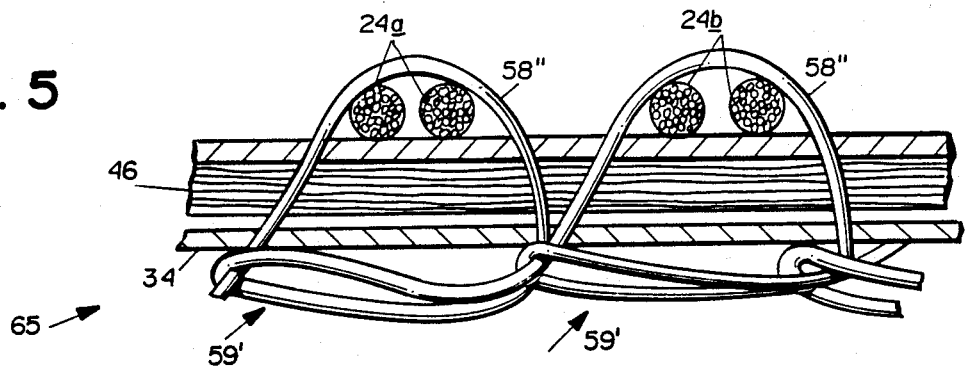
FIG. 5 is a cross-sectional schematic view of the fabric shown in FIG. 4 taken along line 5—5 thereof.

Another substrate (designated by reference numeral 60 in FIG. 1) may also be conveyed from a substrate beam 62 either in addition to, or instead of, substrate 50 such that substrate 60 is interposed between the laid-in warp yarns 46, on the one hand, and the laid-in weft yarns 24*a*–24*d*, on the other hand. A fabric 65 in accordance with this embodiment of the invention is shown in acompanying FIGS. 4 and 5.

In the case where only substrates 34 and 60 are employed, the warp yarns 46 will be laid in between a front face of substrate 34 and a back face of substrate 60. The weft yarns 24*a*–24*d* will, in turn, be laid in on a front face of the substrate 60 so as to be visible with underlap 58" of stitch loops 59' on the technical face of fabric 65. The stitching yarns 22*a*–22*d* are therefore stitched through both of the substrates 34 and 60 to thereby positionally hold the warp and weft yarns 46 and 24*a*–24*d* relative to one another and relative to each of the substrates 34 and 60. Moreover, it will be observed that since the weft yarns 24*a*–24*d* are inserted in the loops formed by the stitch underlap 58", these yarns will be positionally maintained on the technical face side of the fabric 65.

Figure 6:
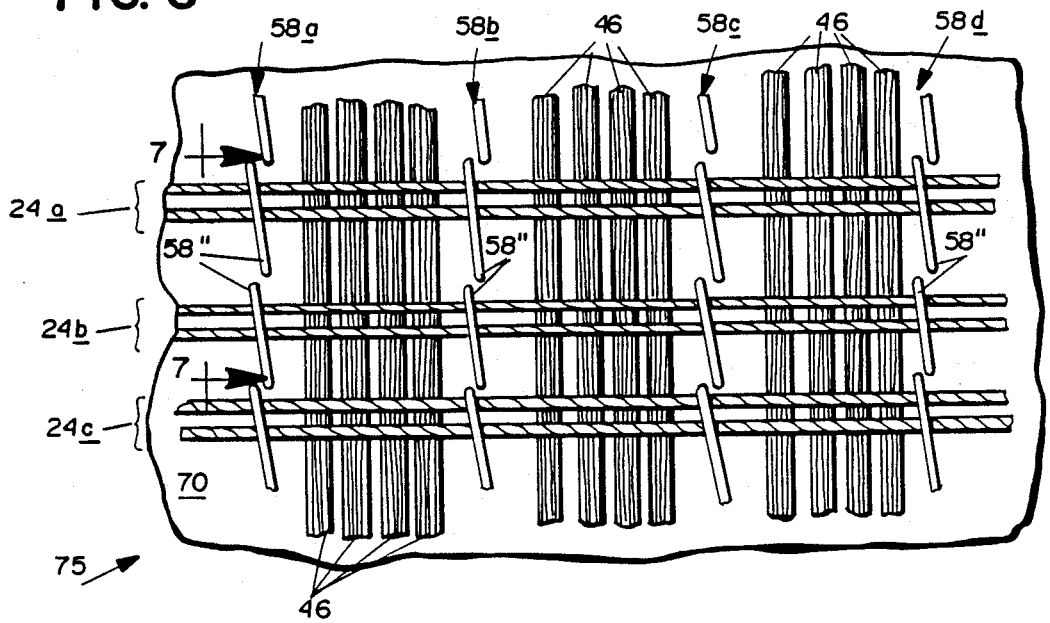
FIG. 6 is a schematic plan view of yet another exemplary fabric of this invention.
Figure 7:
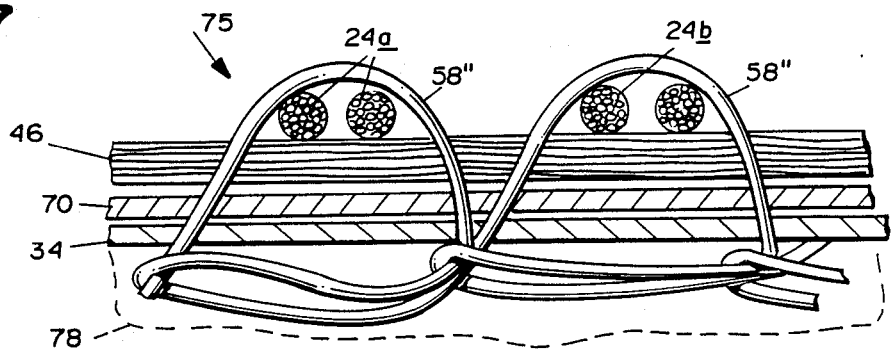
FIG. 7 is a cross-sectional schematic view of the fabric shown in FIG. 6 taken along line 5—5 thereof.

As yet another embodiment of the invention, a pair of substrates (designated by reference numerals 34 and 70 in FIG. 1) may be fed to knitting area 12 in juxtaposed relationship to one another. The fabric 75 obtained by this embodiment of the invention is shown in accompanying FIGS. 6 and 7. In this embodiment the decorative warp and weft yarns may have any desired configuration.

Any suitable material may be utilized for substrates 34, 50, 60 and/or 70 and the selection of any particular substrate will be dependent upon numerous factors, including, among others, the substrate's weight, visual appearance (e.g., whether or not it is dyed, textured, etcetera), hand, dimensional stability, cost, and the like. Suffice it to say that the fabric designer may choose any combination of substrates so as to achieve a particular finished textile product for a given end use. As examples, one substrate may exhibit differing (complementary) physical properties as compared to the other substrate(s); the substrate positioned adjacent the fabric "face" may be dyed, printed or otherwise especially prepared while the other substrate(s) may be positioned on the fabric's "back" and thus chosen for its self-lining, sun-reflectivity, insulative, or other like physical properties; the substrates may be identical, in which case better self-lining properties are achieved as compared to use of a single substrate. Preferably, however, the substrates will be in the form of nonwoven fabrics formed of synthetic textile fibers, but natural textile fibers and blends may suitably be employed. Films could also be used.

It is also possible according to this invention to use thermoplastic fibers (such as low melting-point polyethylene fibers) in the fabrics of the present invention so that upon application of heat (as by passing the fabric through the nip of a pair of heated rollers 76 as shown in FIG. 1), such fibers will be plasticized to fuse adjacent portions of the fabric together to create a stronger, more dimensionally stable fabric upon cooling. If used, such fibers may be part of the substrates themselves or inserted separately as part of the warp and/or weft yarns. For example, the thermoplastic fibers may be used as warp yarns 46 (or any preselected number thereof) and/or weft yarns 24*a*–24*d* (or any preselected number thereof). Also, the thermoplastic fibers may be positioned as weft yarns 24' as shown in FIG. 3. The use of such a thermoplastic component can be helpful to increase the abrasion resistance of the fabric for use as upholstery fabric.

The fabrics of this invention may thus be provided with a relatively "loose" (i.e., low density) warp and weft construction which serves to reinforce the multiple substrates and thus provide dimensionally stable textile fabrics. And since the fabrics of this invention are dimensionally stable even with their "loose" warp and weft construction, they may be produced at lesser costs as compared to fabrics having "tighter" constructions.

As can be appreciated, the present invention is certainly not limited to the exemplary fabric designs shown in the accompanying FIGURES nor is it limited to the use of chain stitches. Thus, for example, the stitch underlap 58" of stitch yarns 22*a*–22*d* may be provided in a decorative pattern in the manner shown in commonly-owned U.S. Pat. No. 4,608,290 (incorporated by reference herein) so as to enhance the aesthetic appearance of the resulting fabric. The warp and/or weft yarns themselves may be single-ply, double-ply, triple-ply, etcetera, and dyed, textured or printed so as to achieve the desired "color field" and/or fill density.

Although the substrates of this invention permit the fabric designer to produce WKWI fabrics which are self-lined, it may be necessary or desirable to have a coating layer of a suitable synthetic material on a side of the fabric. Thus the fabrics of this invention may include such a coating layer as is shown in dashed line in FIG. 7 as reference numeral 78.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A warp-knit, weft-inserted fabric comprising at least first and second substrate layers, warp yarns extending in the warp-wise direction of said fabric, weft yarns extending in the weft-wise direction of said fabric, at least one of said warp and weft yarns is interposed between said at least first and second substrate layers, and warp stitching yarns forming stitch wales spaced apart along the warp-wise direction of said fabric and being stitched through said at least first and second substrate layers to hold said warp and weft yarns in position relative thereto.

2. A warp-knit, weft-inserted fabric comprising a first substrate layer, plural warp yarns laid on a face of said first layer and extending in the warp-wise direction of said fabric, plural weft yarns laid over said warp yarns and extending in the weft-wise direction of said fabric, a second substrate layer laid over said warp and weft yarns, and stitching yarns stitched through said first and second layers for holding said warp and weft yarns therebetween.

3. A warp-knit, weft-inserted fabric comprising a first substrate layer, plural warp yarns laid on a face of said first layer, a second substrate layer laid over said warp yarns, plural weft yarns laid over said second layer, and stitching yarns stitched through said first and second layers so as to hold said warp and weft yarns in position on said first and second layers, respectively.

4. A warp-knit, weft-inserted fabric comprising first and second substrate layers, warp yarns laid on a face of one of said substrates, weft yarns laid over said warp yarns, and stitching yarns forming stitch loops stitched through said first and second substrate layers to hold said warp and weft yarns in position on said one substrate, the stitch loops disposed on one side of said second substrate layer, and the stitch underlap disposed over said warp and weft yarns.

5. A warp-knit, weft-inserted fabric according to claim 1 wherein at least one of said first and second substrate layers is a nonwoven fabric.

6. A warp-knit, weft inserted fabric according to claim 1 further comprising a coating layer applied to a second face of said first substrate layer.

7. A warp-knit, weft-inserted fabric according to claim 1 further including at least some thermoplastic fibers.

8. A warp-knit, weft-inserted fabric having multiple fabric layers, warp yarns, and weft yarns, and wherein at least one of said warp and weft yarns is interposed between at least one pair of said multiple fabric layers, and warp stitching yarns stitched through said at least one pair of fabric layers and positionally holding said warp and weft yarns thereto.

9. A fabric as in claim 8, wherein both said warp and weft yarns are interposed between said at least one pair of fabric layers.

10. A fabric as in claim 8, further comprising a coating layer on at least one face thereof.

11. A fabric as in claim 8, further comprising thermoplastic fibers.

12. A fabric as in claim 8, wherein only said warp ɾarns are interposed between said at least one pair of ɑbric layers, while said weft yarns are positioned ɡainst a front face of one of said fabric layers in said at east one pair thereof.

13. A warp-knit, weft-inserted fabric according to ɛlaim 2 wherein at least one of said first and second ubstrate layers is a nonwoven fabric.

14. A warp-knit, weft inserted fabric according to ɛlaim 2 further comprising a coating layer applied to a econd face of said first substrate layer.

15. A warp-knit, weft-inserted fabric according to ɛlaim 2 further including at least some thermoplastic ibers.

16. A warp-knit, weft inserted fabric according to ɛlaim 3 wherein said at least one of said first and second ubstrate layers is a nonwoven fabric.

17. A warp-knit, weft inserted fabric according to laim 3 further comprising a coating layer applied to a econd face of said first substrate layer.

18. A warp-knit, weft-inserted fabric according to laim 3 further including at least some thermoplastic ibers.

19. A warp-knit, weft-inserted fabric according to laim 4 wherein at least one of said first and second ubstrate layers is a nonwoven fabric.

20. A warp-knit, weft inserted fabric according to laim 4 further comprising a coating layer applied to a econd face of said first substrate layer.

21. A warp-knit, weft-inserted fabric according to laim 4 further including at least some thermoplastic bers.

22. A method of making a warp-knit, weft-inserted ɑbric comprising the steps of:

(i) providing at least first and second substrates to a knitting area of a warp knitting area;

(ii) laying-in warp yarns on a front face of said first substrate while laying-in weft yarns over said laid-in warp yarns; and (iii) stitching through said first and second substrates with warp stitching yarns to hold said warp and weft yarns in position with respect to said first and second substrates.

23. A method of making a warp-knit, weft-inserted fabric comprising the steps of:

(i) providing at least first and second substrates to a knitting area of a warp knitting area;

(ii) laying-in warp yarns on a front face of said first substrate while laying-in weft yarns on a front face of said second substrate; and (iii) stitching through said first and second substrates with warp stitching yarns to hold said warp and weft yarns in position with respect to said first and second substrates.

24. A method as in claim 22 wherein said weft yarns are laid-in over said warp yarns such that said warp and weft yarns are positioned between said first and second substrates.

25. A method as in claim 23 wherein said weft yarns are laid in on a front face of said second substrate such that said warp yarns are positioned between said first and second substrates and such that said weft yarns are inserted into loops formed by the underlap of stitches formed by said warp stitching yarns.

26. A method as in claim 22 or 23, further comprising the step of laying in at least some thermoplastic fibers.

27. A method as in claim 26, further comprising the step of subjecting said warp-knit, weft-insertion fabric to elevated temperature so as to plasticize said thermoplastic fibers, and then allowing said fabric to cool so that said thermoplastic fibers bond adjacent portions of said fabric thereto.

28. A method as in claim 27 utilizing heated roll means to subject said fabric to said elevated temperatures.

* * * * *